United States Patent [19]

Taylor

[11] 4,097,304

[45] Jun. 27, 1978

[54] CLEANING COKE OVEN DOORS

[75] Inventor: George Taylor, Middlesbrough, England

[73] Assignee: British Steel Corporation, London, England

[21] Appl. No.: 738,628

[22] Filed: Nov. 3, 1976

[30] Foreign Application Priority Data

Nov. 10, 1975 United Kingdom ..... 46408/75

[51] Int. Cl.[2] ..... B08B 1/00; B08B 3/02; B08B 7/04

[52] U.S. Cl. ..... 134/6; 15/93 A; 134/34; 134/39; 134/180; 201/2; 202/241; 239/186; 239/568

[58] Field of Search ..... 134/6, 34, 39, 167 R, 134/168 R, 174, 180, 199; 15/93 A; 201/2; 202/241; 239/568, 186

[56] References Cited

U.S. PATENT DOCUMENTS

| | | | |
|---|---|---|---|
| 2,302,299 | 11/1942 | Court | 202/241 X |
| 3,056,699 | 10/1962 | Randell et al. | 15/93 A X |
| 3,660,859 | 5/1972 | McCullough | 15/93 A |
| 3,847,753 | 11/1974 | Baird et al. | 202/241 |
| 3,892,250 | 7/1975 | Miko | 134/168 R |
| 3,987,964 | 10/1976 | Pittman et al. | 134/34 X |

*Primary Examiner*—Richard V. Fisher
*Attorney, Agent, or Firm*—Bacon & Thomas

[57] ABSTRACT

Apparatus and method for removing tarry deposits from the sealing surface of coke oven doors. At least the lowermost portion of the sealing surface is cleaned by reciprocating, fan-shaped, high pressure water jets, directed so as to undercut the tarry deposit. Removal of the deposits from the side portions of the sealing surface may be accomplished by the use of movable scraper blades which on encountering a hard deposit are adapted to be pressed more firmly into the deposit.

13 Claims, 9 Drawing Figures

CLEANING COKE OVEN DOORS

This invention relates to cleaning coke oven doors.

Coke oven doors may be of the self-sealing kind, which require no additional sealing medium to effect a substantially gas-tight seal between the door and the door jamb. Such doors may rely on metal-to-metal contact between the machined door jamb and a relatively narrow sealing diaphragm extending around the edge of the door. When the door is removed to allow coked coal to be discharged from the coke oven, it is usually necessary to clean tar and carbon from the sealing diaphragm of the door to prevent a build-up of tarry deposits which would prevent proper sealing. The deposits are usually most severe at the lower edge and at immediately above the lower corners of the door.

The present invention provides in a broad aspect a cleaning machine for a vertical coke over door having a relatively narrow peripheral sealing surface, said machine including means for directing a high pressure liquid jet of water or an aqueous cleaning solution onto the peripheral sealing surface to remove tarry deposits from the exposed sealing surface, and movable carrier means to enable the water jet to be traversed at least across the lowermost portion of the sealing surface.

According to a further aspect of the invention, a method is provided for removing tarry deposits from a vertical coke oven door having a peripheral sealing surface, which method includes directing a high pressure water jet onto the peripheral sealing surface and traversing said jet at least across the lowermost portion of the door.

It is not always necessary that all tarry deposits be entirely removed from the whole sealing surface of the door. It is however preferred that substantially all deposits should be removed from the seal in the region where the high pressure water jets are delivered. It is particularly preferred that the water jets should be traversed along the sealing surface for at least the distance between adjacent jets, to treat a continuous length of sealing surface, and further that the jets should reciprocate along the sealing surface to carry out more than one cleaning pass.

It is desirable to prevent significant build-up of the deposits by regular use of the invention whenever the coke oven doors are opened for the purpose of pushing coke from the oven.

The effectiveness of the water jets depends on the pressure of the water at the nozzles, the rate at which water is passed through the nozzles and the configuration of the jet itself, and also depends on the distance between the nozzles and the sealing surface of the door. This distance is desirably as short as possible, consistent with adequate dispersion of the jet to clean a sufficiently wide area of the seal and the avoidance of the chance of direct contact between the nozzle and the deposits or even the sealing surface itself. Distances between ½ inch and one inch may be suitable. Water pressures at the nozzle between 3000 and 5000 psi, and flow rates between 0.1 and 0.2 liters per second may prove generally useful. A flat fan-shaped jet has been found particularly suitable, the long dimension of the jet pattern lying perpendicular to the direction in which the jet is traversed along the sealing surface.

The high pressure water jets can of course be used to clean the whole of the peripheral sealing surface, in the sense of removing tarry deposits therefrom. However it is usually possible to remove tarry deposits from the whole of the sealing surface except the lowermost portion by mechanical scraper blades. Thus the use of high pressure water jets is generally confined to those areas which can be more satisfactorily cleaned by the water jets than by other means. In the case of a conventional upright rectangular self-sealing coke oven door, the lowermost portion of the sealing surface may be considered to be the lower horizontal section of the sealing surface, together with the two lower corners and a short distance up each of the vertical sections of the sealing surface.

The carrier means may further be adapted to enable a further water jet to be traversed across at least the uppermost portion of the sealing surface.

The nozzle means may be adapted to provide a flat jet which is inclined at an acute angle to the sealing surface, so that in use the jet acts to undercut the tarry deposit as the jet traverses the sealing surface. The nozzle means may be further adapted to provide two jets, both of which are inclined at an acute angle to the sealing surface but in opposite senses so as to provide undercutting of the tarry deposit when the nozzle means is reciprocated across the sealing surface.

The nozzles are supported and moved linearly and continuously along at least the lowermost portion of the sealing surface in such a manner that the long dimension of the water jet is always directed across the narrow width of the sealing surface while the nozzle is moved. As indicated previously, this movement would be carried out around the corners of the sealing surface.

The scrapers may be of a novel kind having a pivoted blade urged by resilient biassing means outwardly, i.e., the cutting edge of the blades are biased towards the sealing surface of the doors, in which the blade edge leads the pivot axis in the scraping direction and lies outermost of the scraper assembly so that on encountering a hard deposit the blade tends to be pushed outwardly to press more firmly into the deposit. There is preferably provided stop means to prevent undue outward movement of the blade, whether under the influence of the biassing means or through encountering resistant deposits.

The invention is illustrated by way of example in the accompanying drawings in which.

Figure 1:
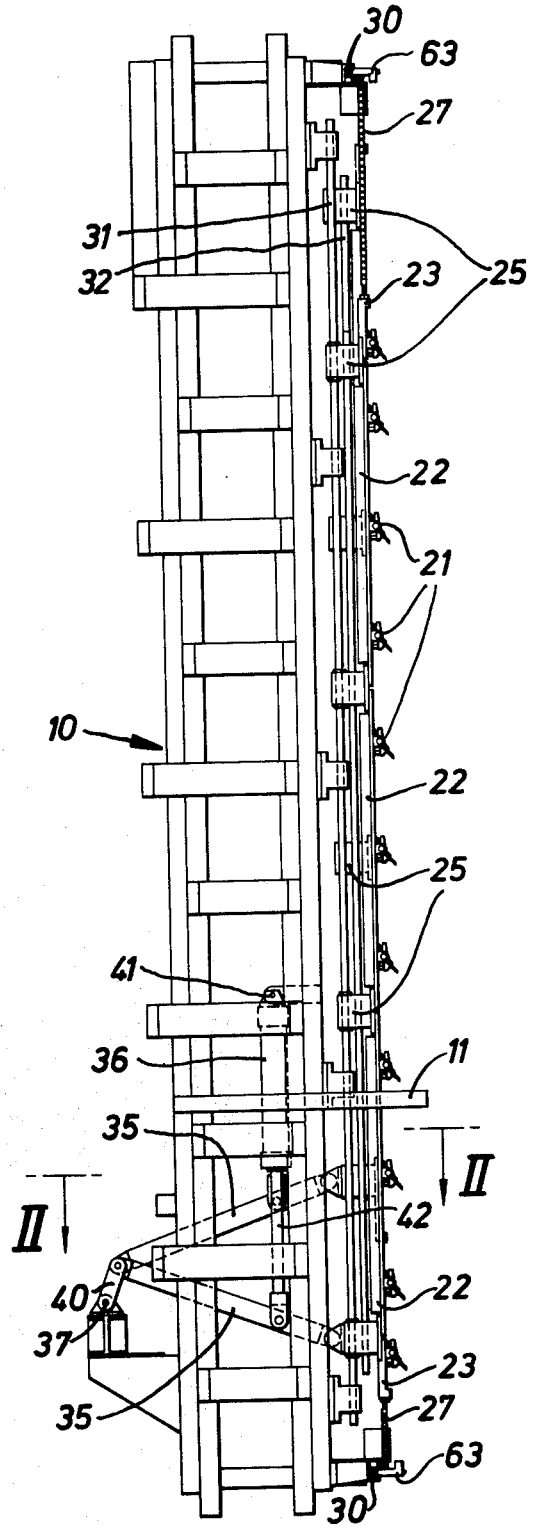
FIG. 1 is a general view in side elevation of one embodiment of a door cleaning machine.

The mechanism shown in the drawings is suitable for use with a conventional upright rectangular coke oven door of the self-sealing kind. Such a door has a relatively narrow, continuous peripheral sealing surface comprising a metal diaphragm lying adjacent the edges of the door. The diaphragm is straight along the sides of the door and is curved at the corners of the door. The end portions of the diaphragm extend generally horizontally and are connected to the side portions. The diaphragm faces forwardly of the door, i.e., towards the interior of the coke oven when in use.

Figure 2:
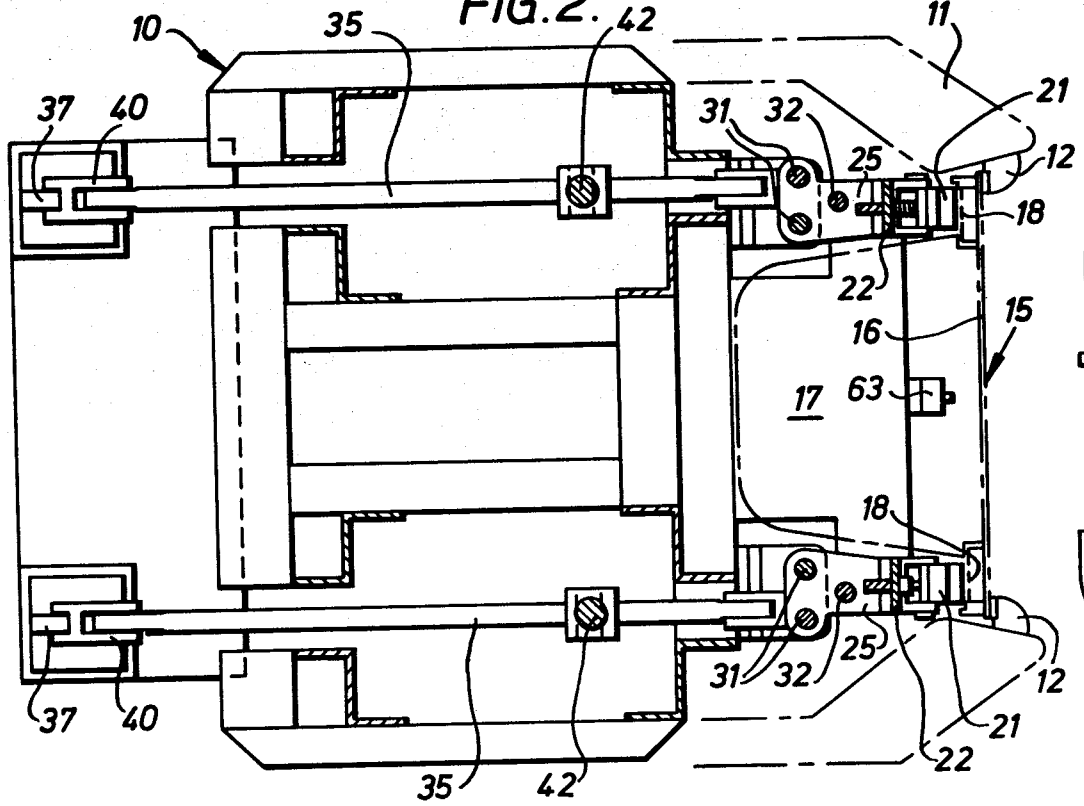
FIG. 2 shows a section taken between II — II as shown in FIG. 1.

In FIGS. 1 and 2 it can be seen that the mechanism is based on the structural framework 10 of a conventional door cleaning machine having a door gripping mechanism 11, the latter (chain dotted in FIG. 2) having latches 12 for securely retaining a coke oven door 15 (also chain dotted) in an exact position. The door is shown to comprise a steel backing plate 16, a central refractory plug 17 and the circumferential sealing diaphragm 18. The door and the gripping mechanism are conventional and do not need to be further described.

The long upright side portions of the sealing surface of the door are cleaned by two arrays of scraper elements 21, only the nearer scraper elements being shown in FIG. 1 for the sake of clarity. Each array is made up of 11 individual scraper elements equally spaced and oriented so that their blades point downwards. On each side of the machine the scraper elements are mounted so that three are carried on each of three rails 22 and one is carried on each of two shorter end rails 23, the rails on each side being carried on sliding blocks 25, which also serve to link the rails together.

The shorter end rails 23 at each end of the scraper rail assemblies are linked to roller chains 27 which, passing along guide channels 30 at the ends of the framework 10 corresponding to the short horizontal sides of the door 15, connect the arrays of scraper elements on either side of the mechanism.

The sliding blocks 25 are slidably mounted on pairs of guide rails 31, which are in turn fixed to the framework 10 in alignment with the long vertical sides of the door. This mounting allows the arrays of scraper elements limited freedom of movement back and forth along the framework.

Separate connecting rods 32 on each side of the framework pass through the sliding blocks 25 and are clamped to them, linking them all together on each side.

Each lowermost sliding block 25 on the sides of the mechanism is linked to a lever arm 35 each of which transmits motive power from a hydraulic cylinder 36. Each lever arm 35 is part of a linkage in which the remote end of the arm is connected to a fixed pivot 37 by way of a short pivotal link 40; the links 40 allow the sliding blocks 25 to reciprocate along the guide rods 31 in a straight line as the lever arm moves.

The hydraulic cylinders 36 are pivotally mounted on the framework 10 at 41. Their pistons work on the lever arms 35 by means of connecting rods 42.

The two hydraulic cylinders are constrained to work always in opposite senses by means of a simple control mechanism; while one piston is being extended, the other is being retracted. By virtue also of the connection by the roller chain 27 between the scraper rails 22 on either side of the framework 10, the scraper elements themselves move in opposite directions. While one array moves downwardly along one side of the coke oven door, scraping at the tarry deposits, the other moves upwardly along the other side of the door having little direct cleaning effect on the door, but cleaning to some extent the scraper blades by virtue of their reverse movement.

The stroke of the cylinder 36, the position at which its connecting rod 42 is mounted on the lever arm 35 and the separation between the scraper elements 21 is such that every relevant part of the sealing strip on the door is scraped by at least one scraper blade.

Figure 3:
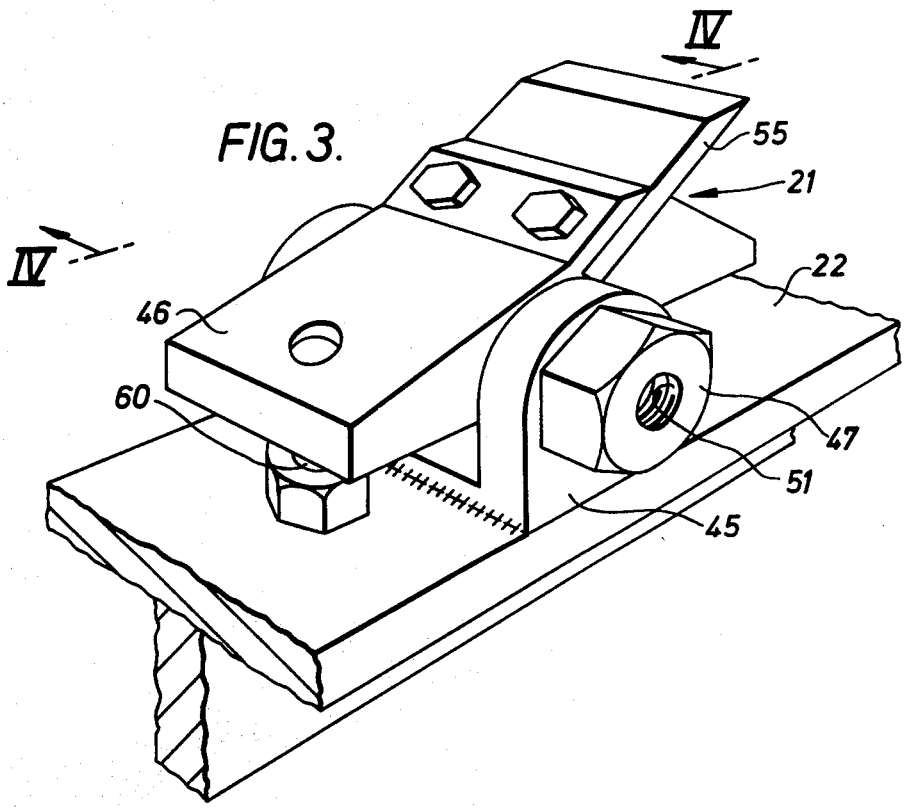
FIG. 3 is an isometric view of one scraper element.
Figure 4:
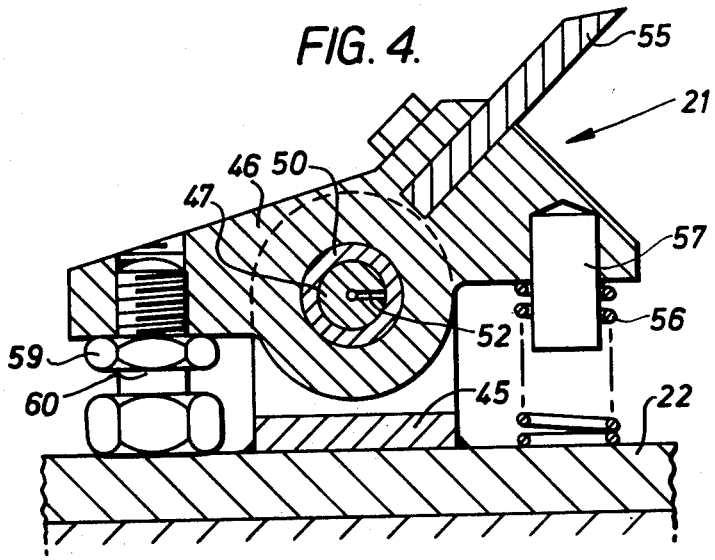
FIG. 4 shows a section through the scraper element taken between IV — IV as shown in FIG. 5.

The scraper elements 21 are shown in more detail in FIGS. 3 and 4. Each comprises a cradle 45 welded to the head of the rail 22. A scraper head 46 is pivotally mounted on a partially threaded pin 47 screwed between the ears of the cradle 45, a bearing bush 50 being provided in the scraper head. The pin 47 is provided with an internal screw thread 51 for a lubricating nipple and a passageway 52 for lubricant.

The scraper head carries a scraper blade 55 bolted into a slot in its leading end. The blade is biassed away from the rail 22 by a spring 56, located over a pin 57, acting between the rail and the leading end of the scraper head. Rocking movement of the scraper head on the pin 47 is limited by a bolt 60 screwed into the trailing end of the scraper head, the bolt head abutting the rail 22. The bolt 60 together with the rail 22 provide a stop means which prevents undue outward movement of the blade, whether under the influence of the biassing means or through encountering resistant deposits. The normal attitude of the scraper head, in which the blade is fully outwardly extended by the spring 56, can be adjusted by the bolt 60, which can be secured by a check nut 59.

The leading or cutting edge of the blade 55 leads the pivot pin 47 and lies outermost of the scraper element so that, when the scraper is moving downwardly along the door, i.e., is on its cleaning stroke, and encounters a particularly resistant deposit, such as carbonized tar, the blade tends not to be pushed over the deposit but to bite into it.

The bolt 60 is adjusted so that the blade is, in use, just clear of the sealing diaphragm 18 of the coke oven door, for example by one-sixteenth inch, to allow the surface to be scraped clean but to prevent it biting into and damaging the sealing surface itself.

Figure 5:
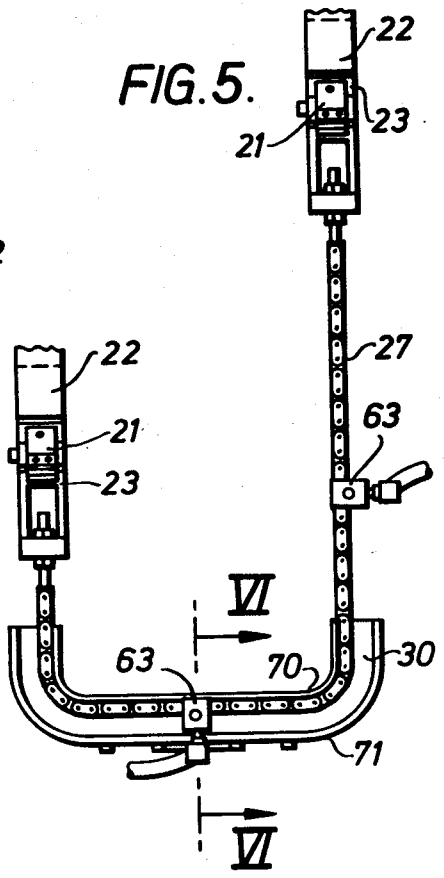
FIG. 5 is a partial view in elevation of one end of the cleaning machine of FIG. 1.
Figure 6:
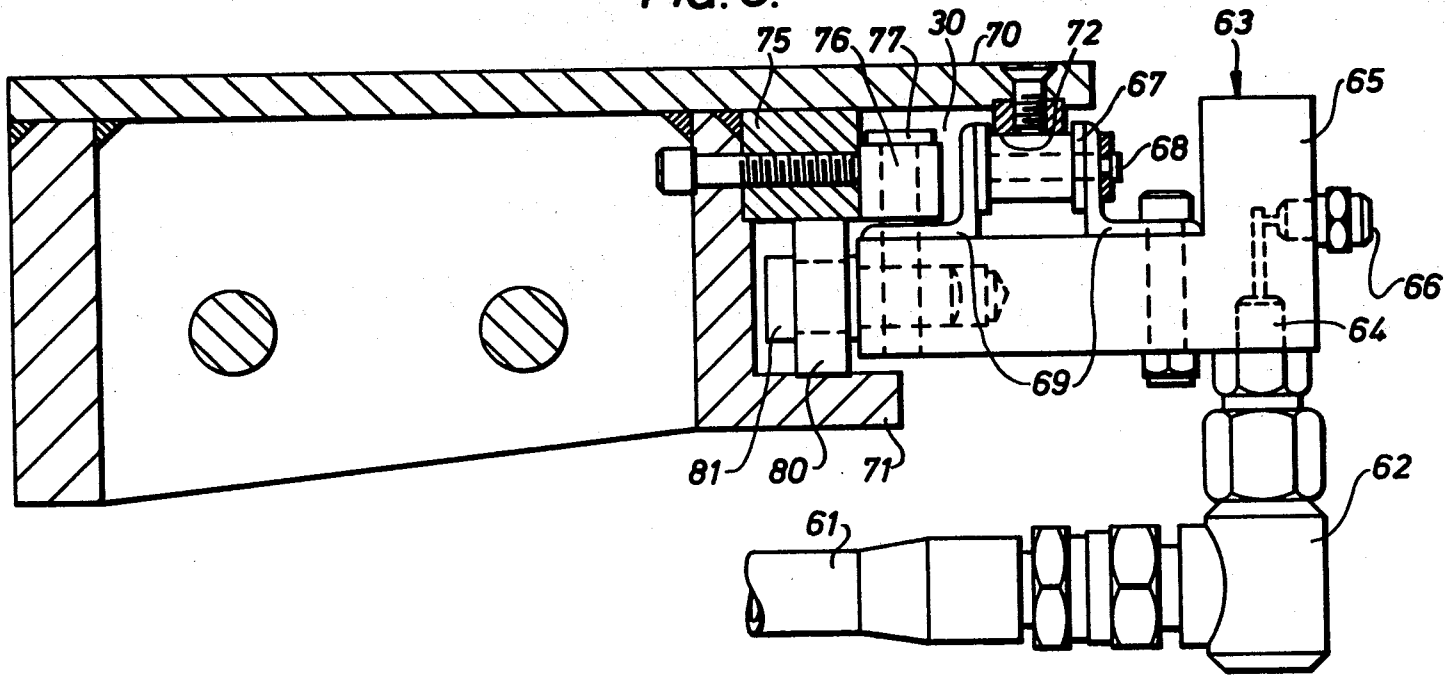
FIG. 6 is a section on line VI — VI of FIG. 5.

FIGS. 5 and 6 show one arrangement of how the high pressure water jets are provided. Each jet is produced from a spray unit 63. Each spray unit comprises a flexible hose 61 through which high pressure water is delivered by way of a swivelling coupling 62 to a nozzle block 65 having an internal bore 64 which leads the water to the nozzle 66. Two spray units 63 are carried generally in fixed spaced relationship to each other on each of the roller chains 27. Each spray unit is mounted on an adapted chain link 67, in which longer rivets 68 hold a pair of angle brackets 69 which in turn carry the nozzle block 65.

Each chain 27 is guided around one end and the two adjacent corners of the door cleaning mechanism by similar guide channels 30, one being shown in section in FIG. 6. The end of the door cleaning mechanism and the adjacent corners, of course, are located in suitable fashion so the spray units 63 will traverse the lowermost area of the sealing surface when they are moved by actuation of the chain 27. Likewise, spray units at the upper area of the cleaning machine will traverse the upper area of the sealing surface, including the upper corners. The channel 30 is defined by two spaced flanges 70 and 71. The inner flange 70 carries near its forward edge a guide rail 72 against which the chain abuts as it passes along the channel. The inner flange 70 carries at the base of the channel a roller guide rail 75 which is the prime supporter of the nozzle block 65 under thrust from the high pressure water jet issuing from the nozzle 66.

The thrust is transmitted principally through a roller 76 carried on roller bearing pin 77 screwed into the side of the nozzle block. However, the roller 76 is not directly behind the nozzle 66 and a turning moment thereby arises which is taken by a roller 80 carried on a roller bearing pin 81 screwed into the base of the nozzle block. The roller 80 is restrained from excessive movement away from the roller guide rail 75 by the proximity of the outer flange 71 by the guide channel 30.

The nozzles 66 are so positioned that they are ⅝ inch from the sealing diaphragm 18 of the coke oven door 15 when it is held by the latches 12 of the door gripping mechanism 11. The nozzles form and direct water jets of flat fan-shaped configuration with an included angle which can optionally be changed from 80° to 95° or 100°. The jet orifices are made of tungsten carbide and formed to give the jet pattern. The pressure and volume of water at the jets can be adjusted in the ranges of 3000 psi. to 5000 psi. and 0.13 liters per second to 0.17 liters per second. The combination of pattern of spray, pressure and volume of water can be adjusted to suit the prevailing conditions of the coking process.

It is desirable that the minimum effective pressure and volume be used and it is found that pressure at 4000 psi. and volume at 0.15 liters per second with a 110° jet angle is generally adequate with 5000 psi. and 0.17 liters per second only required to effectively remove most severe and obstinate deposits which sometimes occur during periods of abnormal coking process. The use of 80° jet angle is confined to recovering the condition of door seals which for other reasons have been neglected and not cleaned at the end of each coking cycle.

Adjustment of the jet angle can be achieved simply by fitting the selected nozzle.

The hydraulic cylinders 36 traverse the nozzles 66 and scraper elements 21 through 30 inches in 8 seconds. Such a pass ensures adequate overlap between the sprayed and the scraped areas of the sealing diaphragm 18. One pass in each direction constitutes a full cycle. One cycle is usually sufficient to substantially remove deposits, but any number of passes can be applied.

The long dimension of the fan-shaped jet always extends across the narrow width of the seal when the nozzle traverses the sealing surface, including the corners of the lowermost portion of the sealing surface, by the supporting and traversing system shown and described herein; i.e., the chain and guide channels.

Figure 7:
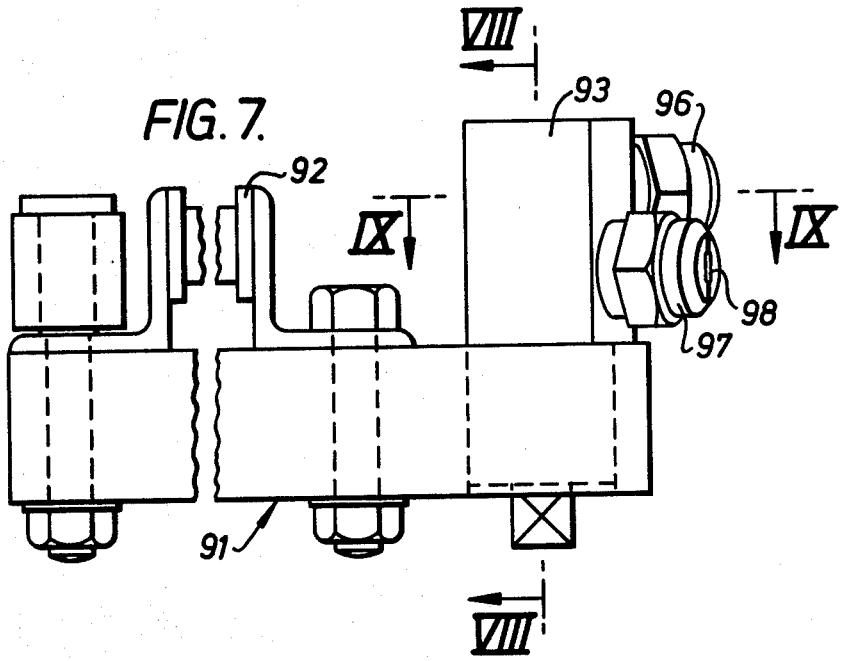
FIG. 7 shows an alternative version of the water spraying arrangement illustrated in FIG. 6.
Figure 8:
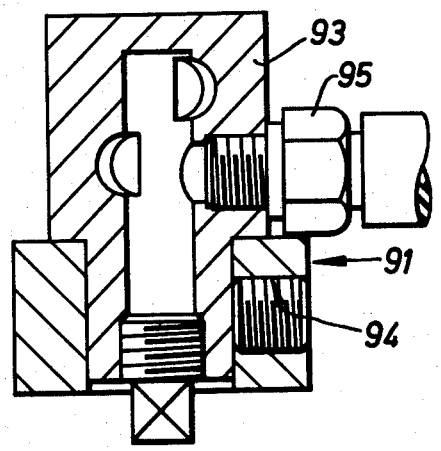
FIG. 8 is a view on line VIII — VIII of FIG. 7.
Figure 9:
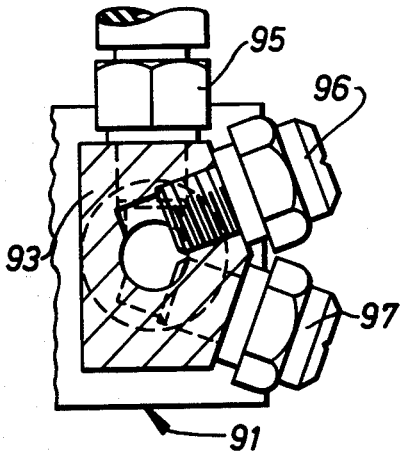
FIG. 9 is a view on line IX — IX of FIG. 7.

An alternative water spraying arrangement is shown in FIGS. 7 to 9. In this arrangement a carrying block 91 is secured to an adapted chain link 92 in a manner similar to that described with reference to FIG. 6. A separate nozzle block 93 is fitted into a circular hole drilled near the end of the carrying block 91 adjacent the door to be cleaned, and is secured in position by a grub screw (not shown) fitting in further hole 94 tapped into the carrying block 91. A coupling 95 is screwed into the nozzle block 93 for the admission of water under high pressure from a suitable pump and hose arrangement into the hollow central portion of the nozzle block 93.

Two nozzle assemblies, 96 and 97 respectively, are fitted into the nozzle block 93. Each nozzle assembly has an orifice 98 which produces a flat fan-shaped water jet, the long dimension of the jet pattern lying perpendicular to the direction in which the jet is traversed along the sealing surface (i.e., always across the narrow width of the sealing surface). Further, each nozzle is positioned so that the respective jets are directed at an acute angle, i.e., 80° to the sealing surface, each jet being set in an opposite sense. There is thus an angle of forty degrees between the two flat-shaped jet fans. When the nozzle block is traversed in either direction along the sealing surface, the jets as arranged will have an undercutting effect on the tarry deposit present on the sealing surface, thereby assisting in its removal.

We claim:

1. A method of removing tarry deposits from an elongated narrow sealing surface of a generally rectangular coke oven door, the sealing surface extending continuously about the peripheral side and end areas of the inner surface of the door, comprising simultaneously scraping the side portions of the sealing surface with bladed elements while directing a moving, high pressure, fan-shaped liquid jet of water or an aqueous cleaning solution at the lower end area of the seal surface, the bladed elements and the jet being reciprocated along the seal surface, the jet being oriented so its long dimension always extends across the narrow width of the seal surface, and the jet being directed to intersect the seal surface at an acute angle.

2. The method as claimed in claim 1, wherein simultaneous scraping and jet movement is obtained by mechanically interconnecting the bladed elements and the jet.

3. A method as claimed in claim 1, wherein the liquid is water, the jet pressure is between 3,000 and 5,000 psi (211 and 352 Kgs/sq. cm) and the water flow rate is between 0.1 and 0.2 liters per second.

4. A method of removing tarry deposits from an elongated narrow sealing surface of a generally rectangular coke oven door, the sealing surface extending continuously about the peripheral side and end areas of the inner surface of the door, comprising:

simultaneously scraping the side portions of the sealing surface with bladed elements while directing two moving, high pressure, fan-shaped liquid jets across the lower end portion of the seal surface, the bladed elements and the jets being moved in a reciprocating sense along the seal surface, the jets being oriented so the long dimensions of the jets always extend across the narrow width of the seal surface, the jets being directed to intersect the seal surface at an acute angle, and the jets being supported in fixed relationship with each other so when they are moved along the seal surface in reciprocating fashion, they each are directed over at least adjacent portions of the seal surface.

5. A cleaning machine for a vertical rectangular coke oven door having a peripheral sealing surface, said surface comprising two side portions joined by upper and lower end portions, the machine including movable carrier means adapted to traverse at least a portion of the door sealing surface, and spaced scapers carried on the movable carrier means, said scrapers each having a pivoted blade urged by resilient biassing means towards the sealing surface of the door, and wherein the edge of each blade leads the pivot axis in the scraper direction and lies outwardly of the scraper assembly so that on encountering a hard deposit the blade tends to be pushed outwardly to press more firmly into the deposit.

6. A machine as claimed in claim 5 in which there is provided stop means to prevent undue outward movement of each blade, whether under the influence of the biassing means or through encountering resistant deposits.

7. A cleaning machine for a vertically oriented rectangular coke oven door having a relatively narrow continuous sealing surface on one side of the door extending along the peripheral edge area of the door, the sealing surface including opposite side portions and opposite, horizontally extending, upper and lower end portions, the machine comprising:

at least one moveable nozzle means for forming and directing a flat, fan-shaped high pressure liquid jet of water or an aqueous cleaning solution against the sealing surface;

means for supporting and carrying the nozzle means linearly and continuously along at least a portion of the length of the lower end portion of the sealing surface and along at least part of the length of one of the side portions of the sealing surface; and means for maintaining the long dimension of the liquid jet always directed across the narrow width of the sealing surface while the nozzle is moved.

8. A machine as claimed in claim 7, including at least one additional moveable nozzle means for forming and directing a flat, fan-shaped high pressure liquid jet against the sealing surface; and additional means supporting and carrying the additional nozzle means linearly and continuously along at least a portion of the length of the upper end portion of the sealing surface and along at least part of the length of one of the side portions of the sealing surface; means for maintaining the long dimension of the liquid jet always directed across the narrow width of the sealing surface when the additional nozzle is moved; and means for moving the said nozzle simultaneously along the sealing surface.

9. The machine as claimed in claim 7, said nozzle means being arranged to direct the jet at an acute angle relative to the sealing surface.

10. The machine as claimed in claim 7, said nozzle means being arranged to form and direct two flat, fan-shaped jets at an acute angle relative to the sealing surface but in opposite directions, whereby the jets are directed at an angle to the sealing surface in either direction of travel of the nozzle.

11. The machine as claimed in claim 7, including a plurality of scrapers supported for movement adjacent to and along the side portions of the sealing surface and means for reciprocally moving the scrapers along at least the said side portions so that the scrapers adjacent each side portion move in opposite directions for scraping accumulations from the sealing surface, said nozzle means and scrapers all being supported and connected together for simultaneous reciprocal movement, the scrapers including blades extending at an acute angle relative to the sealing surface.

12. A machine as claimed in claim 11, wherein each scraper blade is mounted for pivotable movement about a pivot axis whereby the cutting edge can move towards and away from the sealing surface, with the cutting edge urged by resilient biasing means towards the sealing surface of the door, with each blade edge leading the pivot axis in the scraper direction and lying outwardly of the scraper assembly so that on encountering a hard deposit, each blade tends to be pushed outwardly to press more firmly into the deposit.

13. A machine as claimed in claim 12, in which each scraper is provided with stop means to prevent undue outward movement of the cutting edge of the blade towards the sealing surface, whether under the influence of the biassing means or through encountering resistant deposits.

* * * * *